US005544997A

United States Patent [19]

Raynor

[11] Patent Number: 5,544,997

[45] Date of Patent: Aug. 13, 1996

[54] DEVICE FOR EXPEDITING THE CUTTING OF BOXES

[76] Inventor: Joe W. Raynor, 216 Church View Dr., Rocky Mount, N.C. 27804

[21] Appl. No.: 511,631

[22] Filed: Aug. 7, 1995

Related U.S. Application Data

[63] Continuation of Ser. No. 174,346, Dec. 28, 1993, abandoned.

[51] Int. Cl.[6] ..... B26D 5/20

[52] U.S. Cl. ..... 414/412; 83/946; 269/13; 269/17; 269/55; 414/786

[58] Field of Search ..... 83/23, 54, 946; 108/20, 21, 22, 94; 269/13, 17, 55, 57, 63; 414/412, 786

[56] References Cited

U.S. PATENT DOCUMENTS

| | | | |
|---|---|---|---|
| 1,891,090 | 12/1932 | Hall . | |
| 1,898,910 | 2/1933 | Stein . | |
| 2,904,308 | 9/1959 | Vergara | 269/17 X |
| 3,137,068 | 6/1964 | Quigley | 83/946 X |
| 3,457,642 | 7/1969 | Steer et al. . | |
| 3,922,778 | 12/1975 | Aalpoel . | |
| 4,702,920 | 10/1987 | Goodman . | |
| 4,815,392 | 3/1989 | Sööt | 108/94 X |
| 5,033,348 | 7/1991 | Walsh | 83/622 |
| 5,101,703 | 4/1992 | Tanaka et al. | 83/946 X |

FOREIGN PATENT DOCUMENTS

| | | | |
|---|---|---|---|
| 63-93537 | 4/1988 | Japan | 269/57 |

*Primary Examiner*—Michael S. Huppert
*Assistant Examiner*—Janice L. Krizek
*Attorney, Agent, or Firm*—John G. Mills and Associates

[57] ABSTRACT

The invention is a device for expediting the cutting of boxes containing goods used in restocking shelves and the like. This device can either be free standing or operatively mounted on a stocking cart or dolly. In either case, a free-wheeling turntable is used to support the box being cut and a box positioner is disposed adjacent thereto to raise one edge of the box when the same is being cut. This positioner can then be lowered to allow the box to be rotated 90° for the next cut, etc. thereby greatly expediting the cutting open of boxes. The box positioner for raising the box at least partially off of the turntable is mechanically activated by either a foot pedal in the free standing version or by a handle in the cart mounted version.

12 Claims, 4 Drawing Sheets

FIG. 3
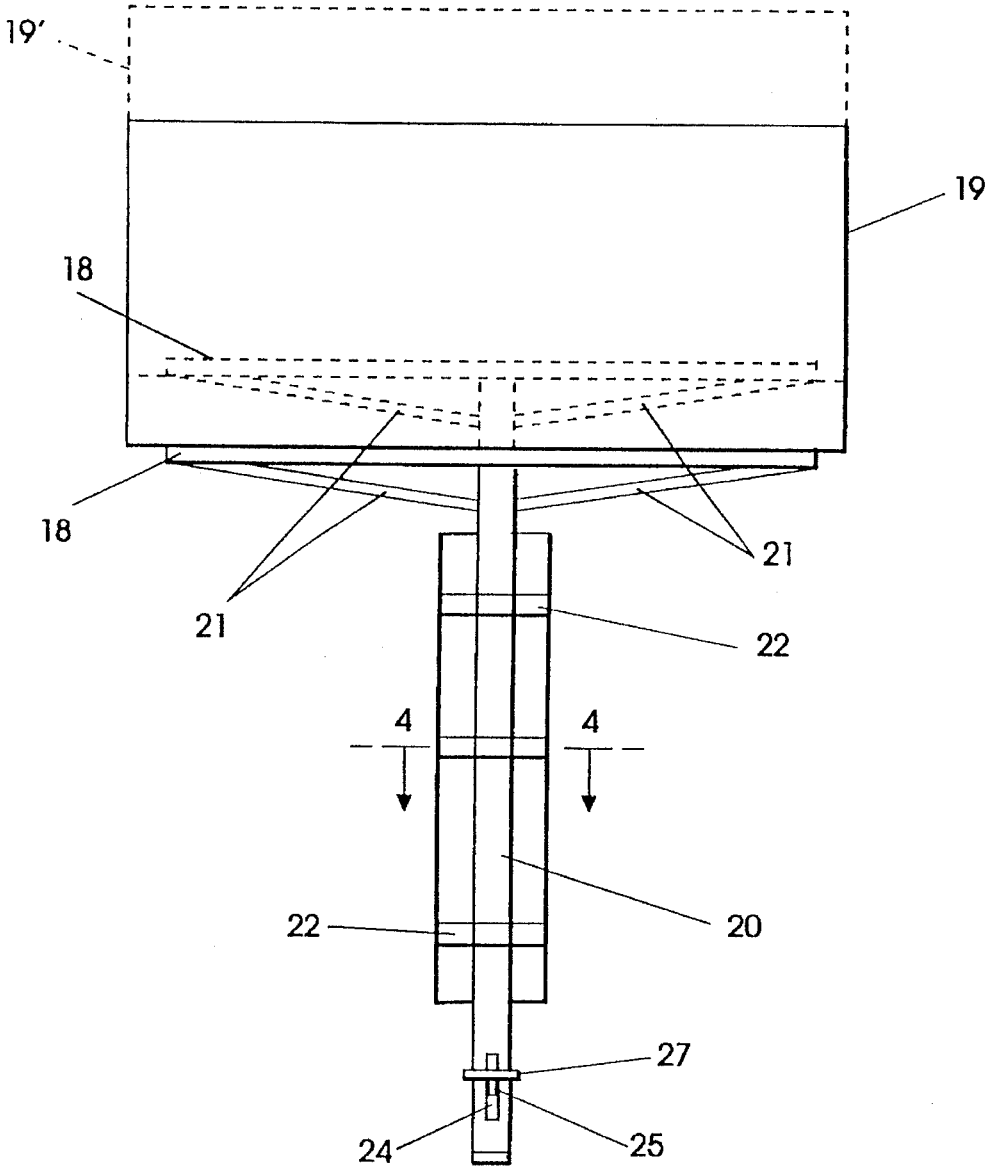
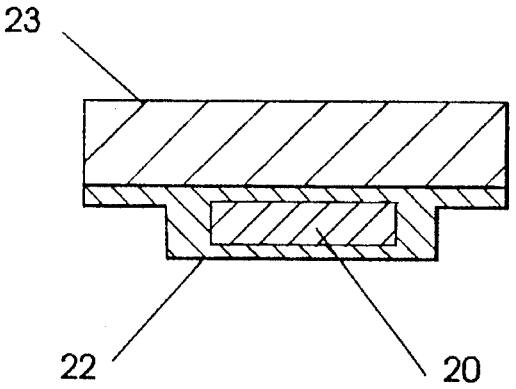
FIG. 4

DEVICE FOR EXPEDITING THE CUTTING OF BOXES

This application is a continuation of application Ser. No. 08/174,346, filed Dec. 28, 1993, now abandoned.

FIELD OF INVENTION

This invention relates to store stocking systems and more particularly to means for expediting and cutting of boxes to open the same.

BACKGROUND OF INVENTION

The opening of shipping containers such as pasteboard boxes in stores and warehouses has always been a problem. With the development of supermarkets, discount stores and warehouse wholesale/retail outlets the problems have been magnified. In all of these various businesses, the shelves have to be constantly restocked.

Elongated dollies that carry between 40 and 50 boxes are rolled from the storeroom to the shelving area. The boxes are then cut around the top with a razor and the goods therein stocked on the shelves or the boxes cut in half and used as a shelf display.

Although a number of different types of machines have been developed to cut boxes of the type set forth above, stocking in retail stores is still primarily done by a stocking clerk who finds a place to sit the box and the clerk then cuts the top edge along one side, rotates the box 90°, cuts the next side, rotates the box another 90°, etc. until the top has been removed. This process takes between 15 and 20 seconds per box which equates into a considerable amount of time over an extended period.

The following references represent the closest prior art of which the inventor is aware:

Concise Explanation of References

U.S. Pat. No. 1,891,090 is a cigarette pack opener wherein the pack is placed upside down in a holder and rotated to contact a blade to cut a slot adjacent one edge thereof.

U.S. Pat. No. 1,898,910 to Stein discloses a paper box opening machine that is electrically operated with a rotary saw blade actually doing the cutting. The box in this reference must be turned during the cutting process.

U.S. Pat. No. 4,702,920 to Goodman is considered of interest in that it discloses a potter's wheel that is electrically driven and is controlled through the manipulation of a foot pedal.

U.S. Pat. No. 5,033,348 to Walsh is considered of interest in that it discloses a box cutting machine disposed next to a conveyor with knives that are hydraulically activated, upon contact of a switch, to cut the box.

U.S. Pat. No. 3,137,068 to Quigley is considered of interest in that it discloses a carton slitting mechanism including a means for rotating the carton as it moves along a conveyor belt.

Finally, U.S. Pat. Nos. 3,457,642 to Steer et al and 3,922,778 to Aalpoel are considered of general interest in that they disclose combination conveyors and box openers.

BRIEF DESCRIPTION OF INVENTION

After much research and study into the above-mentioned problems, the present invention has been developed to provide a free standing device for expediting the cutting of boxes which includes a means for attaching the device to any standard stocking cart or dolly. There is a generally flat surface at a convenient height with a turntable extending slightly thereabove. The box to be cut is placed on the turntable and is spun around while the operator holds a razor at the desired location to be cut. This procedure takes between three and five seconds or one third or less time than the manual method of cutting, rotating, cutting and rotating, etc. that is done in most stocking operations today.

A foot activated mechanical box lifter is provided that can be used to stop the rotation of the box on the turntable and also to raise the box for cutting. This is particularly useful when the box is being cut as a building display or self contained tray. Once cut, any parts of the boxes that are removed, i.e. the tops, portions of the side, the front, etc., these can be placed in a detachable box and any plastic wrap can be placed in a separate, detachable, receptacle for easy removal when full.

There are no fixed cutting blades or saws on the present invention and no parts are electrically or hydraulically driven. The present invention is also a portable, self contained, compact device that allows the user thereof to expedite cutting of boxes in supermarkets, food stores and the like. The present invention further allows a box to be cut between one sixth and one third of the time that it now takes a stacking clerk to make the same cut manually.

In view of the above it is an object of the present invention to provide a device for expediting the cutting of boxes.

Another object of the present invention is to provide a means for expediting the cutting of boxes that has no fixed or mechanical cutting blades or saws and requires no electrical or hydraulic drives.

Another object of the present invention is to provide a portable, self contained device for expediting the cutting of boxes that can be used independently or connected to stocking carts and/or dollies.

Another object of the present invention is to provide a device that takes only one sixth to one third of the time to cut a box compared to manually cutting of the same.

Another object of the present invention is to provide a device for expediting the cutting of boxes including a free wheeling turntable.

Another object of the present invention is to provide a device for expediting the cutting of boxes that includes a free wheeling turntable and a box lifting mechanism.

Other objects and advantages of the present invention will become apparent and obvious from a study of following description and the accompanying drawings which were merely illustrative of such invention.

BRIEF DESCRIPTION OF DRAWINGS

FIG. 3 is a front elevational view thereof;

FIG. 4 is a sectional view taken through lines 4—4 of FIG. 3;

DETAIL DESCRIPTION OF INVENTION

Figure 1:
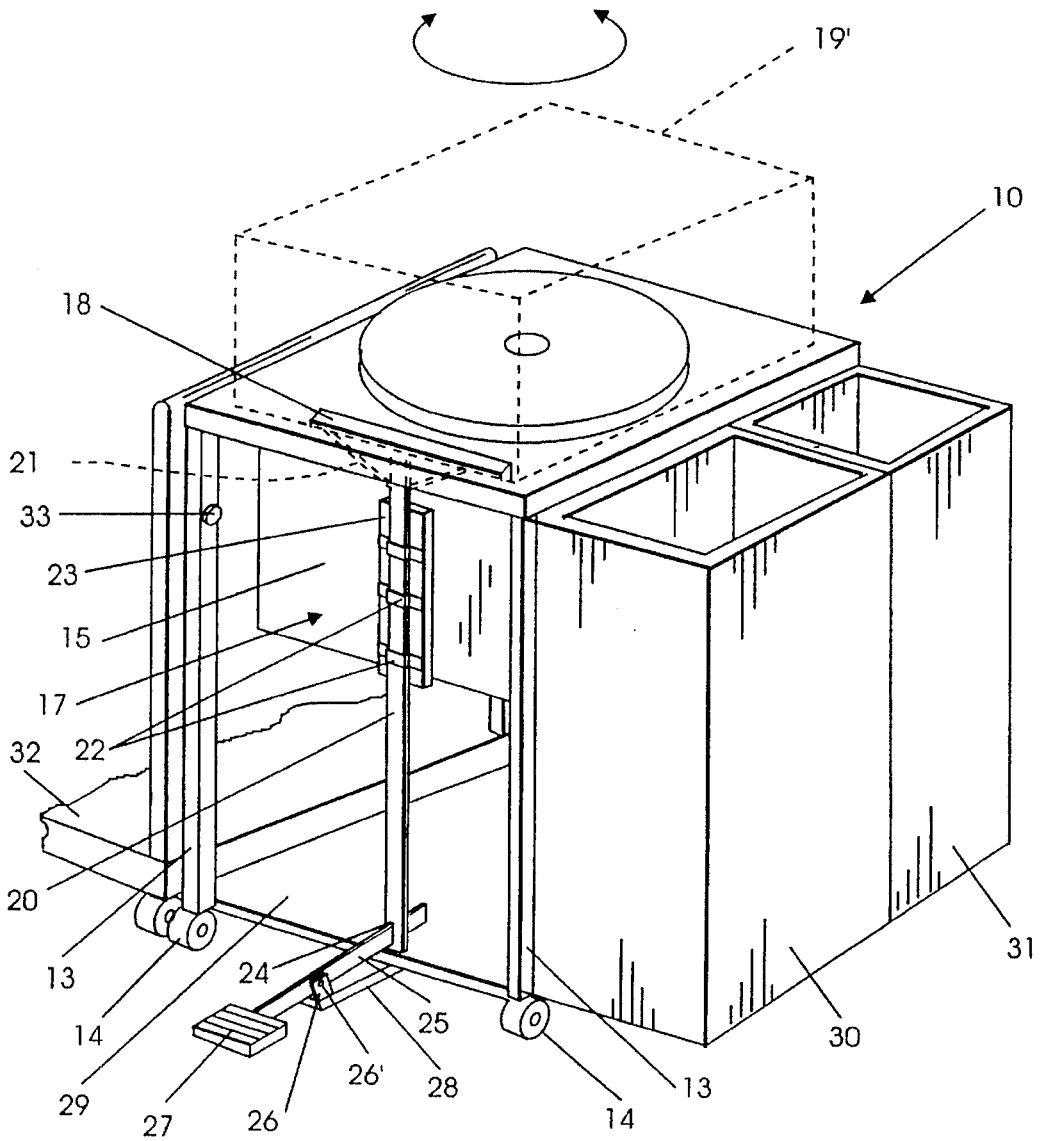
FIG. 1 is a perspective view of the box cutting expeditor of the present invention.

With further reference to the drawings, the box cutting expediter of the present invention, indicated generally at 10, includes a support platform 11 with a turntable 12 mounted thereon. This turntable is free wheeling and can be mounted on the support platform either through the use of ball bearings in raceways, can use pillow block bearings, or other suitable means. Since there are a number of different ways to mount a free wheeling rotatable means, further detailed discussion of this portion of the present invention is not deemed necessary.

In a preferred embodiment of the present invention, depending legs 13 are used to mount the support platform 11 at a convenient height. Although not specifically shown, a means for adjusting the length of the legs 13 to adjust the height of the support platform 11 can readily be provided if desired.

On the lower end of each of the legs 13 are caster wheels 14. Since caster wheels are well known to those skilled in the art, further detailed discussion of the same is not deemed necessary.

A depending substructure 15 blow the support platform 11 is provided. A box positioner, indicated generally at 17, includes a position bar 18 for raising one edge of the box 19' being cut as will hereinafter be described in greater detail.

A lift shaft 20 is affixedly secured at one end to the position bar 18 and includes position bar braces 21 on opposite sides thereof.

A plurality of lift shaft guides 22 are mounted on a guide base 23 which in turn is supported by the the substructure 15. The lift guides allow the lift shaft to move vertically up and down.

The end of lift shaft 20, opposite position bar 18, is slotted as indicated at 24. One end of pedal shaft 25 is mounted in slot 24, is pivoted as indicated at 26, and has a pedal 27 fixedly secured to the opposite end. An outwardly extending bracket 28, from lower shelf 29, mounts the pivot flange 26 that holds the pivot pin 26'.

The lower shelf 29 is mounted between the downwardly extending legs 13. Other suitable bracing can, if desired, be used to support the bracket 28.

Figure 2:
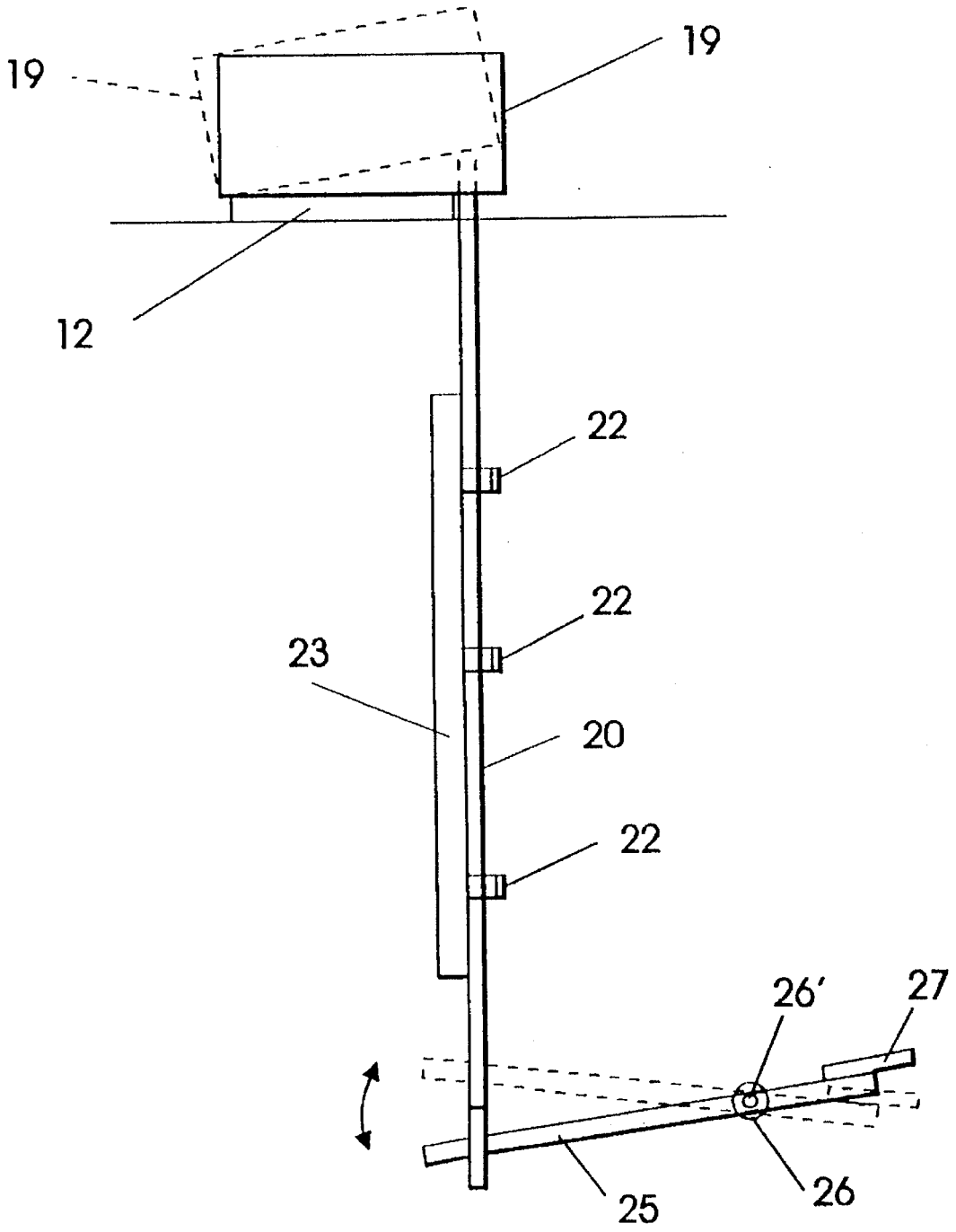
FIG. 2 is a side elevational view in somewhat schematic form of the box positioner.

From the above it can be seen that when the pedal 27 is pushed downwardly from the position shown in solid lines in FIG. 2 to the position shown in dotted lines in such Fig., the pedal shaft 25 will pivot about pivot pin 26' to slide the lift shaft 20 upwardly. The position bar 18 mounted on the upper end of the lift shaft and disposed below the box 19' being cut, will lift said box to the position shown in dotted lines. Releasing downward pressure from the pedal 27 will, of course, allow the box positioner 17 to return to the position shown in solid lines in the Figs.

At least two removable containers are preferably mounted on one side of the box cutting expediter 10 of the present invention. The larger of these containers 30 can be used as a receptacle for parts of boxes removed during the cutting process such as tops, portions of sides, fronts, etc. A smaller receptacle 31 is for receiving other waste material such as plastic wrap and the like that are the by-products of the shelf stocking process.

Stocking carts, or dollies as they are sometimes called, are commonly used by stocking clerks to move boxes of products from storage areas to the display areas. A common stocking cart or dolly 32 is shown in fragmentary view in FIGS. 1 and 6 and in perspective view in FIG. 5.

The box cutting expediter 10 of the present invention shown in FIG. 1 can be used either by itself or can be attached to one end of the stocking cart by any suitable means 33 such as bolts, chains, or the like. Since securing means of this type are well known to those skilled in the art, further detailed discussion of the same is not deemed necessary.

Figure 5:
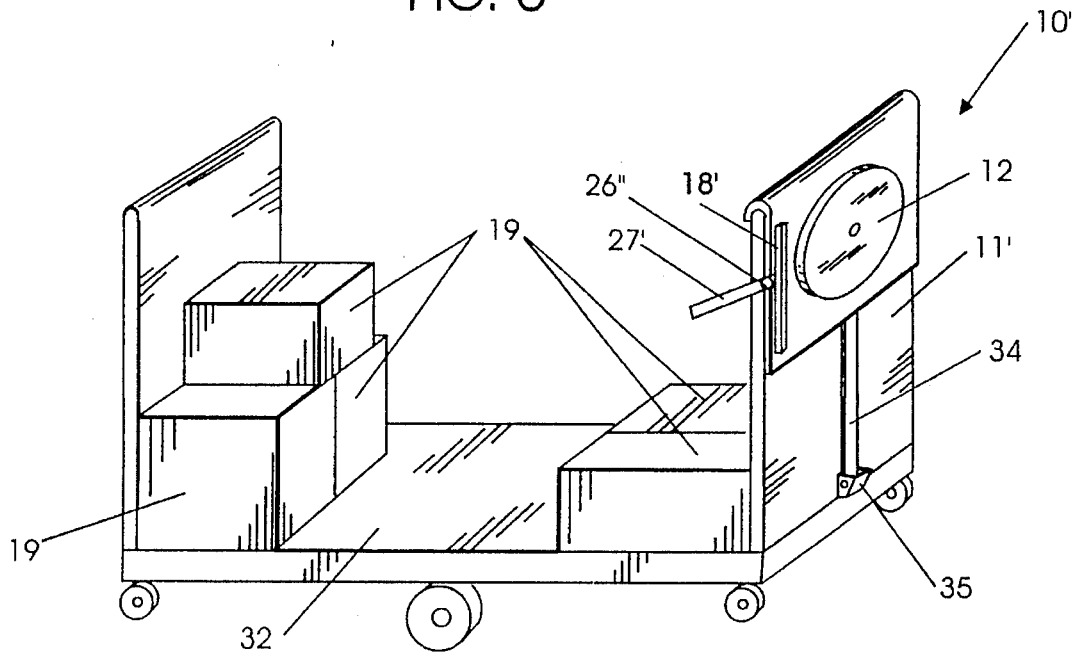
FIG. 5 is a perspective view of a typical stocking cart with a version of the present invention mounted thereon.
Figure 6:
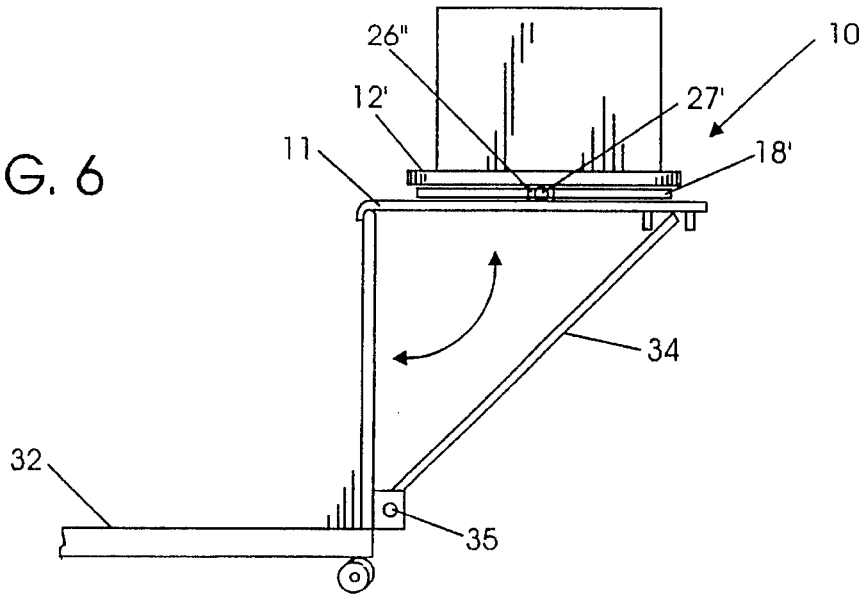
FIG. 6 is a fragmentary side elevational view showing such modification in its use position.

A modified version of the present invention, indicated generally at 10', can be pivotally mounted on one end of the standard stocking cart or dolly 32 and lie flat against the end thereof when not in use as shown in FIG. 5. When the same is needed, it can simply be folded out as shown in FIG. 6 with brace 34, pivotally mounted on bracket 35, being used as a support.

This modification can include a modified box positioner 17'. This positioner includes a position bar 18' on one end of shaft 20', a pivot 26" and an activator in the form of a handle 27' rather than a foot peddle 27.

To use the box cutting expediter 10 of the present invention, the free standing unit shown in FIG. 1 can either be rolled to the use location, or it can be secured to a stocking cart or dolly and then moved to such position, or the folding version can be mounted on one end of the stocking cart as indicated at 10'.

Regardless of which expediter is being used, the boxes of goods 19 are moved on the dolly 32 or other means to the stocking area where they are to be opened. One box at a time is placed on the turntable 12 as indicated at 19'. In most cases the box will overlap the turntable and will also overlie the positioning bar 18 or 18'.

The foot pedal 27 in FIG. 1 can then be depressed which will cause the opposite end of the pedal shaft 25 to move upwardly and its engagement with the lower end of the lift shaft 20 will push the position bar 18 upwardly lifting the box 19'. The box can then be easily cut with a standard razor used for cutting boxes by stocking clerks.

Pressure on the foot pedal 27 is then released which lowers the box 19' back to the free wheeling turntable so the said box can be turned or spun 90°. The pedal is again pushed down, the cut made, and the pedal released. When this process is carried on twice more, and the box is completely cut and the goods therein can be lifted out. Extensive time studies have shown that the average stocking clerk can cut most boxes in between three and five seconds for all four cuts while the process takes between 15 and 20 seconds when the present invention is unavailable and not used.

From the above it can be seen that the present invention has the advantage of providing means for expediting the cutting of boxes during restocking and similar operations. Using the present invention, a box can be cut on all four sides in one third to one forth of the time than required to manually cut the same box. The present invention is relatively inexpensive to produce, requires no expense to operate and no training other than a simple initial demonstration of use.

The terms "upper end", "lower end", "side", "end", etc. have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A box cutting expediter comprising:

a support means having a rectangular planar surface;

a free-wheeling turntable rotatively mounted on said support means for receiving said box;

moveable means for engaging said box while the same is on said turntable to at least partially lift said box off said turntable, said moveable means being positioned horizontally intermediate the periphery of said turntable and a lateral edge of said support means, said moveable means being positioned at a vertical elevation below the surface of said turntable when not in use and being arranged for upward movement for engaging said box as required; and means for selectively operating said moveable means whereby a box to be opened can be placed on said turntable, one edge lifted up to allow easy cutting and can then be lowered and said turntable used to rotate the box 90 degrees for a repeat of the cutting process.

2. The box cutting expediter of claim 1 wherein the means for selectively operating said movable means is a foot operated mechanical means.

3. The box cutting expediter of claim 1 wherein the means for selectively operating said movable means is a hand operated mechanical means.

4. The box cutting expediter of claim 1 wherein said support means is a free standing means.

5. The box cutting expediter of claim 4 wherein said free standing support means is mounted on caster wheels.

6. The box cutting expediter of claim 5 wherein said free-standing support means is connected to a stocking cart.

7. The box cutting expediter of claim 1 herein said support means is mounted on a stocking cart.

8. The box cutting expediter of claim 7 wherein said support means includes a horizontally disposed pivoting means fixedly attached to a lateral edge of said support means, said pivoting means also being operatively connected to a generally horizontal member of said stocking cart whereby said support means and said turntable may be folded downwardly to a vertical position when not in use and may be pivoted upwardly to a horizontal position when in use.

9. A method of cutting a box with a razor knife, said method utilizing a free-wheeling turntable rotatively mounted on a horizontally disposed support means in parallel relation thereto, said support means including moveable means for engaging said box to at least partially lift said box off said turntable, said moveable means being positioned at a vertical elevation below the surface of said turntable when not in use and being arranged for upward movement for engaging said box by selectively operating the same, said method comprising:

positioning a box to be cut on said turntable, holding said knife in substantially parallel relation to said turntable at the desired vertical location on said box to be cut;

cutting a first side wall of said box from corner to corner;

rotating said turntable at intervals of approximately 90 degrees about a center axis thereof while continuing to cut the next adjacent side wall of said box from corner to corner until a cut is extended about the entire perimeter of said box; and removing an unwanted portion of said box exposing the contents contained therein.

10. The method of claim 9 wherein the step of positioning further comprises:

arranging said box on said turntable such that a selected side wall that is to be cut away is positioned over said moveable means;

actuating a selectively operating means to extend said moveable means upwardly to partially lift said side wall to a convenient cutting position;

cutting around the peripheral edges of said side wall;

releasing said selectively operating means in order to retract said moveable means downwardly replacing said box on said turntable; and removing said unwanted side wall for display of the contents contained therein.

11. The method of claim 10 wherein the step of actuating is carried out by a foot operated mechanical means.

12. The method of claim 10 wherein the step of actuating is carried out by a hand operated mechanical means.

* * * * *